United States Patent [19]

Moussou et al.

[11] 3,982,888

[45]*Sept. 28, 1976

[54] HEAT TREATMENT TUNNEL KILN FOR PRODUCTS HAVING A CIRCULAR CROSS-SECTION

[75] Inventors: Jean Moussou, Pouzac; Robert Calvet, Tarbes, both of France

[73] Assignee: Ceraver, Paris, France

[ * ] Notice: The portion of the term of this patent subsequent to Sept. 16, 1992, has been disclaimed.

[22] Filed: July 21, 1975

[21] Appl. No.: 597,788

Related U.S. Application Data

[63] Continuation of Ser. No. 486,256, July 5, 1974, Pat. No. 3,905,758.

[30] Foreign Application Priority Data

July 13, 1973 France ..... 73.25851

[52] U.S. Cl. ..... 432/128; 432/253; 432/131; 432/124; 214/338

[51] Int. Cl.[2] ..... F27B 9/02; B65H 51/00

[58] Field of Search ..... 432/5, 6, 11, 18, 56, 432/121, 122, 124, 128, 131, 137, 138, 141, 152, 153, 186, 189, 225, 253; 214/338, 339

[56] References Cited

UNITED STATES PATENTS

| | | | |
|---|---|---|---|
| 3,737,282 | 6/1973 | Hearn et al. | 432/253 |
| 3,778,221 | 12/1973 | Bloom | 432/128 |
| 3,779,696 | 12/1973 | Poore et al. | 432/5 |
| 3,819,067 | 6/1974 | Hammond | 432/253 |
| 3,905,758 | 9/1975 | Moussou et al. | 432/11 |

*Primary Examiner*—John J. Camby
*Assistant Examiner*—Henry C. Yuen
*Attorney, Agent, or Firm*—Sughrue, Rothwell, Mion, Zinn and Macpeak

[57] ABSTRACT

Heat treatment tunnel kiln for products having a circular cross-section, comprising a main heat treatment zone for circulating tubes or bars perpendicular to their axis, ensuring the rolling of the tubes or bars inside the supports, and zones for circulating the supports parallel to their axis, connected to flow circuits for gases different from those in the main zone.

11 Claims, 5 Drawing Figures

HEAT TREATMENT TUNNEL KILN FOR PRODUCTS HAVING A CIRCULAR CROSS-SECTION

This is a continuation of application Ser. No. 486,256, filed July 5, 1974, now U.S. Pat. No. 3,905,758 issued Sept. 16, 1975.

The present invention concerns a tunnel kiln for the heat treatment of products having a circular cross-section, comprising a main zone provided with means for making the products flow perpendicular to their longitudinal axis and means for subjecting them at the same time to a rotation about that longitudinal axis by rolling in cylinders. It applies more particularly to kilns for the continuous sintering of long cylindrical ceramic parts in a definite atmosphere.

It has already been proposed, in British Pat. No. 18963/74 of Apr. 30, 1974, filed by the assignee of the present application and corresponding to U.S. application Ser. No. 464,091, filed Apr. 25, 1974 now U.S. Pat. No. 3,887,327 issued June 3, 1975, to arrange the products to be subjected to the heat treatment in cylinders fast individually or in a group of at least one structure subjected to a linear movement along the longitudinal axis of the furnace, for example in cylindrical support tubes which are isolated or connected together in drums. That arrangement makes it possible to reduce deformations produced on the products during the heat treatment, more particularly bending deformations, as well as the effects of possible chemical reactions taking place between a part and a support, by continuous modification of the contact zones.

It may, however, be necessary to place the products, during their heat treatment, in different atmospheres and to ensure very thorough exchanges between the products and the gases during their contact in certain zones of the kiln, for example in the product cooling phase.

It is an object of the present invention to enable the products to be put successively into contact with different atmospheres and to reduce the bulk of the kiln and also to ensure, if need be, a thorough ventilation of the products during at least one treatment phase.

The tunnel kiln according to the invention is characterized in that it comprises, moreover, at least one zone besides the main zone and in that the latter and the other zone may be formed connected to different gas flow devices.

It comprises, moreover, preferably at least one of the following characteristics:

The main zone and the other zone are connected to each other by a chamber which may be isolated either from the one or from the other, in a gas-tight manner.

The other zone is provided with means for making the products circulate parallel to their longitudinal axis.

The other zone comprises, moreover, means for subjecting the products to a rotation about their longitudinal axis.

The means for starting up the rotation of the products in the other zone are constituted by helical grooves fast with the cylindrical supports of the products and lugs engaged in these grooves, fast with the inside wall of the said other zone.

The other zone is provided with slide rails for the circulating of the cylindrical supports of the products and the chamber is provided with mobile slide rails which may be brought into the extension of the slide rails of the other zone or be moved away therefrom when the chamber is isolated from the said other zone.

The circulating directions in the main zone and in the other zone are perpendicular to each other.

It comprises preliminary heat treatment and final heat treatment zones provided with means for making the products circulate parallel to their longitudinal axis, arranged on either side of the main zone.

The products are arranged in cylindrical supports provided with means for longitudinal spacing apart, the inside surface of the other zone being provided with seal rings along the outside surface of the supports, arranged in pairs, the distance between the seal rings of one pair being greater than the length of the longitudinal means for spacing the supports apart.

The following description, given by way of an example and with reference to the accompanying drawing, of a firing kiln for ceramic tubes or bars, will make other advantages of the invention become apparent.

Figure 2:
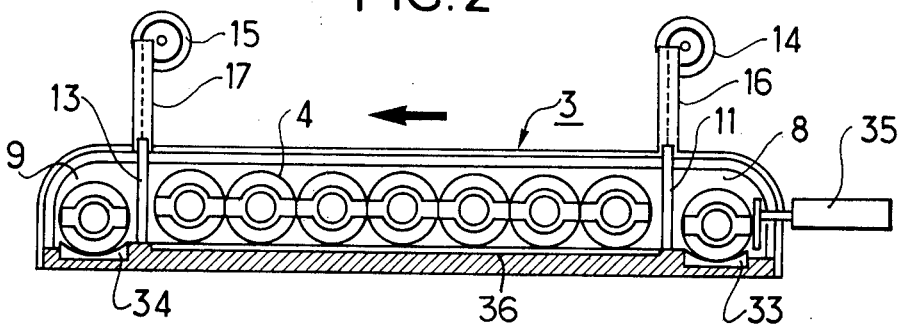
FIG. 2 is a cutaway view through the axis A–A in FIG. 1.
Figure 3:
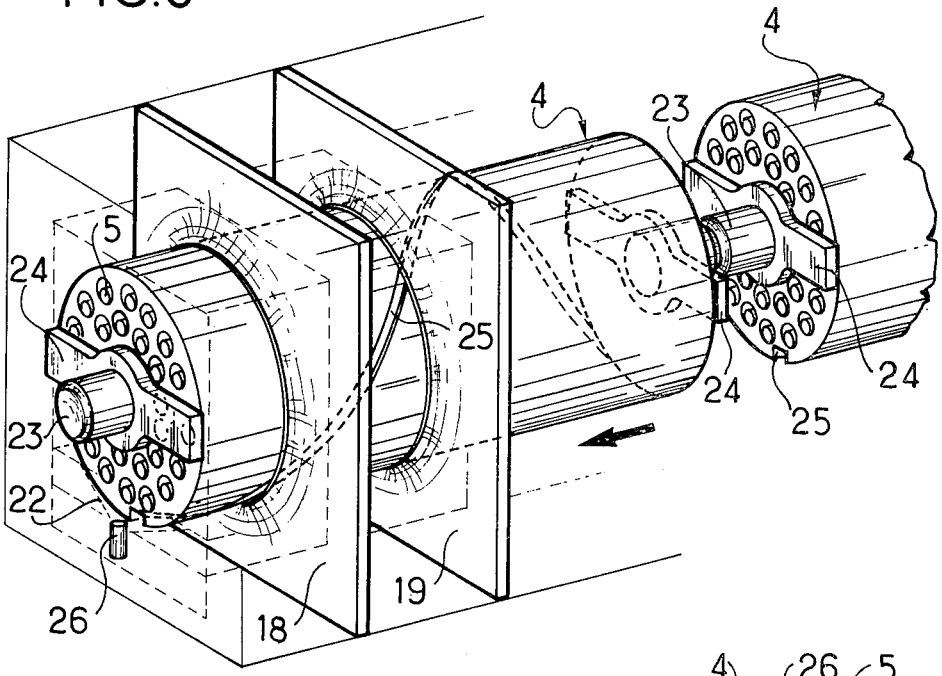
FIG. 3 is a perspective view of a cylindrical support moving in the preliminary treatment zone, as well as its connection of with the following support.

The kiln according to the embodiment described comprises three zones 1, 2, 3. The preliminary treatment zone 1 and final treatment (cooling) zone 2 are arranged parallel and connected by the transversal treatment zone 3. In zones 1 and 2, the cylindrical supports 4 move longitudinally. In zone 3, these supports move perpendicularly to their axis. The products 5 to be fired are arranged in the supports 4 made in the form of drums as shown in FIG. 3. The supports arranged in a contiguous line in zones 1 and 2 are moved by push jacks 6 and 7. Zones 1 and 2 are separated from zone 3 by two chambers 8 and 9, each formed by two gates 10, 11 and 12, 13, the gates 11 and 13 being closed when the gates 10 and 12 are open and vice-versa. The moving of these gates is effected by a vertical sliding movement as shown for gates 11 and 13 in FIG. 2, by means of fluid-tight control devices 14, 15; in the open position, these gates retract into narrow recesses 16, 17 which communicate with the inside of the kiln.

Figure 5:
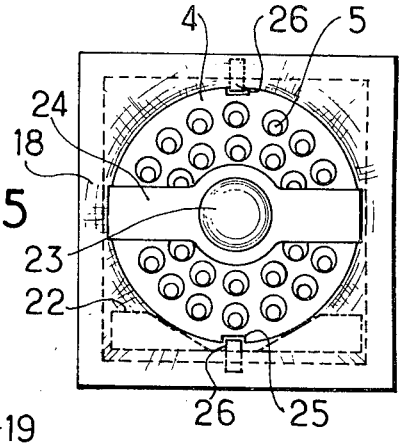
FIG. 5 is a cutaway view through the axis BB in FIG. 4.
Figure 4:
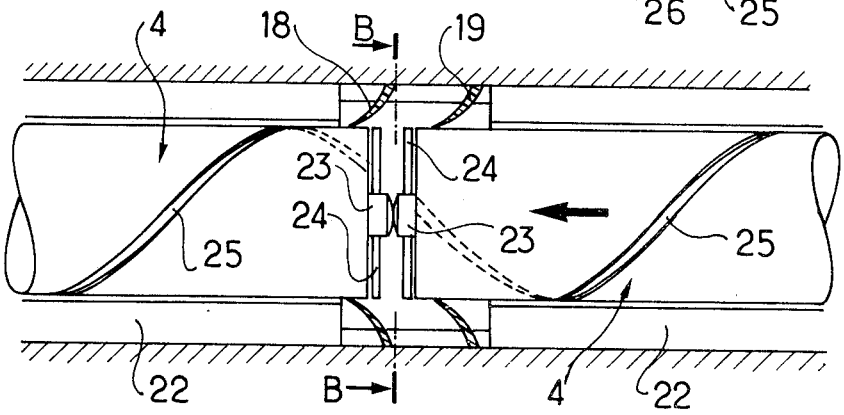
FIG. 4 is a cutaway view, through the axis of the preliminary treatment zone of the kiln, of two successive cylindrical supports crossing through a pair of sealing rings.

Pairs of resilient seals made of carbon felt such as 18, 19 and 20, 21 provide fluid-tight sealing between the inside walls of zones 1 and 2 and the outside surface of the supports 4. These seals, shown more clearly in FIGS. 3 and 5, are arranged in pairs spaced in such a way that if one is between two neighbouring faces of two successive supports 4, the other bears on the outside surface of one support or the other. The distance between one pair of seals and the next is equal to the distance between the front ends of two successive supports.

Zone 1 and 2 are equipped with slide rails 22 (FIG. 5) guiding the axial movement of the supports 4.

The chamber 8 is fitted with mobile slide rails 33 which may be moved by means of sealed control devices (not shown) so as to come into contact with the adjacent end of the slide rails 22 in zone 1. The chamber 9 is also fitted with slide rails 34 similar to the slide rails 22, which they extend with an interruption enabling the closing of the gate 11.

The supports 4 are in the form of drums provided with a shaft 23 adapted to transmit the thrust efforts of the push jacks 6 and 7. Two distance pieces 24 are mounted for free rotation on the protruding stub of each shaft 23 on each support 4. The combined length of each pair of distance pieces 24 is slightly greater than the diameter of the associated support 4, but their width is slighter than the latter, so as not to interfere with the slide rails 22. These relationships are clearly shown in FIG. 5.

In the case where it is required to impart to the tubes to be fired a rotating movement, the supports 4 are provided with helical grooves 25 (FIG. 3). Lugs 26 fixed to the inside walls of the kiln are received in the grooves 25. During the linear movement of the support 4, the reaction of the lugs 26 on the walls of the grooves 25 impose on the supports 4 a rotating movement depending on the pitch of the helical groove.

Figure 1:
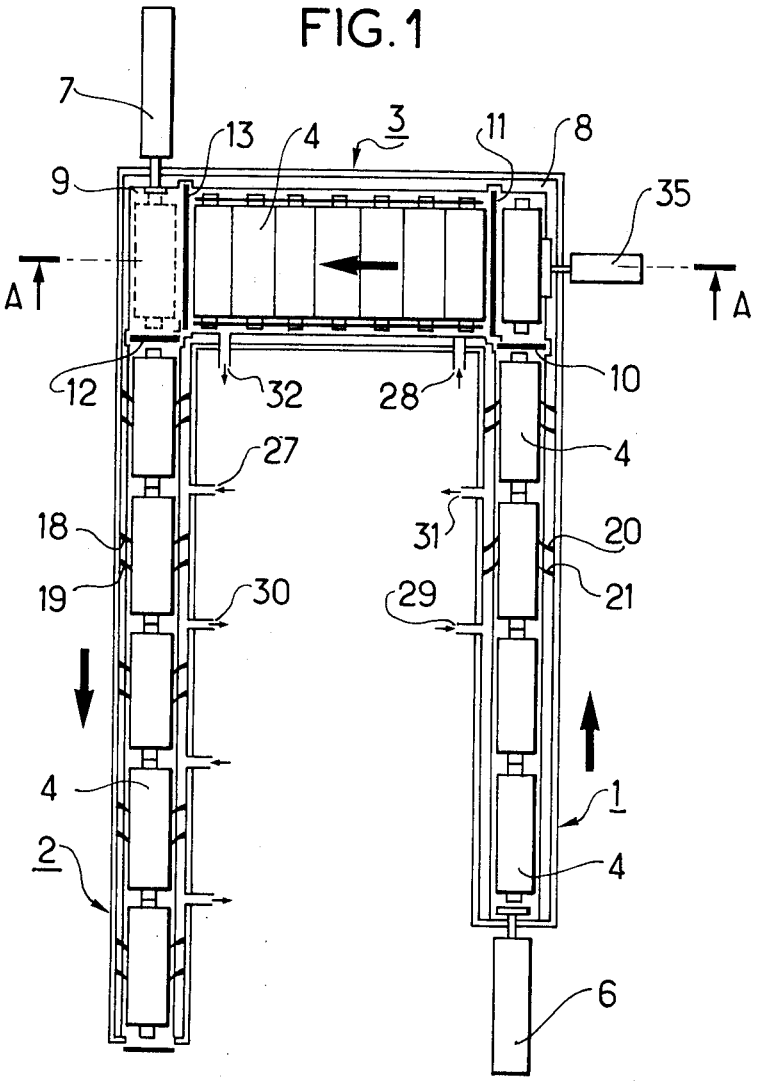
FIG. 1 is a diagrammatic plane view of a kiln comprising a preliminary treatment zone and a final treatment zone for circulating products parallel to their axis, and a main treatment zone for circulating products perpendicular to their axis.

In the zone 3 of the kiln, the supports 4 arranged parallel to one another move perpendicular to their axis under the effect of a thrust initiated by a push rod 35 and transmitted by the contact of the distance pieces 24 which maintains between the supports a slight distance. This slight distance is imperceptible in FIGS. 1 and 2, but it enables the supports 4 to move by rolling on the hearth 36, eliminating all detrimental sliding or friction between adjacent supports 4. The registry of the distance pieces 24 can be maintained by various simple expedients, such as, for instance, locating the center of gravity of the distance pieces 24 directly beneath their respective shafts 23 so that the distance pieces 24 will automatically remain horizontal as the supports 4 roll on their peripheries.

In each of the zones 1, 2, 3 of the kiln, a particular atmosphere may be provided and maintained by an independent flow of gas for which only the input orifices 27, 28, 29 and output orifices 30, 31, 32 are shown. The chambers 8 and 9 are provided also with a gas flow enabling, before any opening of gates, the removal of the atmosphere prevailing therein to let in an atmosphere balanced with that of the zone which will communicate with the chamber. To reduce as much as possible the volume of these movements of gas, the chamber will be given the volume which is the closest to that of the support, compatible with the requirements of manoeuvring.

The circulating of the cylindrical supports is effected as follows:

The various zones 1, 2, 3 of the kiln and the chamber 9 being full, the chamber 8 being empty, and the atmosphere of chamber 8 being balanced with that of the zone 1, the gate 10 is opened and the slide rails 33 are brought forward in contact with the slide rails 22 in zone 1. The jack 6 is started up. The column of supports 4 situated in the zone 1 moves by a length slightly greater than the overall length of a support 4. The slide rails 33 are withdrawn into the chamber 8 so as to permit the passage of the gate 10, which is closed again. The atmosphere of the chamber 8 is then balanced with that of zone 3. During these operations, the atmosphere of the chamber 9 is balanced with that of zone 2. The gate 12 is opened, and the slide rails 34 are brought forward in contact with the slide rails 22 in zone 2. The jack 7 is started up; under its thrust, the cylindrical support 4 contained in the chamber 9 is brought into contact with the column of supports contained in the zone 2, then the column is pushed along a distance equal to the length of a support. The jack 7 and the slide rails 34 are then retracted, and gate 12 is closed again. The atmosphere of the chamber 9 is balanced with that of zone 3. Then, the gates 11 and 13 are opened. The push rod 35 is brought into action. Under its thrust, the cylindrical support 4 contained in the chamber 8 rolls on one of the slide rails 33, then comes again into contact by its distance pieces 24 with the distance pieces of the neighboring cylindrical support 4 contained in zone 3. The supports 4 contained in that zone constitute a layer of parallel but non-tangent cylinders spaced apart regularly by the distance pieces. Under the action of the push rod 35, these cylindrical supports move, rolling on the hearth 36 up to the moment when the support 4 originally situated in the chamber 8 is brought to a position enabling the closing of the gate 11. The push rod 35 is then retracted. A retractable arm (not shown) may be provided to stop the supports 4 other than the one at the head of the column from continuing to roll to the point where they would interfere with the gate 13 after the push rod 35 has reached the end of its stroke.

During that moving, the support 4 at the head of the layer being moved has reached a position on the sloping part of one of the slide rails 34 and, after which it continues to roll under the influence of gravity until it has reached its balance position in the chamber 9. The gates 11 and 13 are closed again. The atmospheres of the chambers 8 and 9 are balanced with those of zones 1 and 2. A support containing products to be fired is brought into the column of supports 4 in zone 1. A cylindrical support containing the fired products is removed from the column in zone 2. Subsequently the operations may begin again.

Although the form of embodiment of the tunnel kiln for heat treatment which has just been described appears preferable, it will be understood that various modifications may be made thereto without going beyond the scope of the invention, it being possible to replace certain of its elements by others which would fulfill the same technical function or a similar function therein. Thus the number of zones of the kiln may be other than three, the kiln assuming the form of an L when it comprises only two zones or being able to comprise, moreover, more than three zones. The supports may be constituted by isolated tubes or tubes fitted together in drums. They may optionally be or not be provided with one or several helical grooves having different pitches. They themselves may be arranged in a tube or an armature through which they cross, that tube or that armature themselves being driven in a rotating movement about their axis and arranged in a zone of the kiln.

In the main zone 3, the structure of the supports and the general structure of the kiln may have characteristics which are the object of the previously mentioned British Pat. No. 18 963/74 of Apr. 30, 1974. The flowing and the purifying of the gases in that zone of the kiln may comprise the arrangements which are the object of British Pat. No. 18 962/74 of Apr. 30, 1974, which corresponds to U.S. application Ser. No. 466,661, filed May 3, 1974.

We claim:

1. A tunnel kiln comprising:

a. a plurality of cylindrical supports, each of which contains at least one cavity shaped to receive an object to be heat treated;

b. means defining a main treating zone;

c. means in said main treating zone for moving said cylindrical supports in a direction perpendicular to their longitudinal axes;

d. means in said main treating zone for rotating said cylindrical support about their longitudinal axes during their translational movement in said main treating zone;

e. means defining a second treating zone;

f. means in said second treating zone for moving said cylindrical support in a direction parallel to their longitudinal axes;

g. a first chamber connecting said main treating zone to said second treating zone, said first chamber being adapted to receive at least one of said cylindrical supports at a time; and h. means for isolating said first chamber in a gas-tight manner from either said main treating zone or said second treating zone.

2. A tunnel kiln as claimed in claim 1 and further comprising means in said second treating zone for rotating said cylindrical support about their longitudinal axes during their translational movement in said second treating zone.

3. A tunnel kiln as claimed in claim 2 wherein said means in said second treating zone for rotating said cylindrical supports about their longitudinal axes during their translational movement in said second treating zone comprises helical grooves in said cylindrical supports and lugs mounted on the inside wall of said second treating zone and received in the helical grooves in said cylindrical support.

4. A tunnel kiln as claimed in claim 1 and further comprising:

a. fixed slide rails for said cylindrical support mounted in said second treating zone and b. mobile slide rails for said cylindrical supports mounted in said first chamber, said mobile slide rails being movable between a first position in which they are in contact with the adjacent end of said first slide rail and a second position in which they are spaced from the adjacent end of said fixed slide rail.

5. A tunnel kiln as claimed in claim 1 wherein the directions of translation of said cylindrical support in said main and second treating zones are perpendicular.

6. A tunnel kiln as claimed in claim 1 and further comprising means for subjecting said main and second treating zones to specified atmospheres by flows of gas having different compositions.

7. A tunnel kiln as claimed in claim 1 and further comprising:

a. means defining a third treating zone;

b. means in said third treating zone for moving said cylindrical supports in a direction parallel to their longitudinal axes;

c. a second chamber connecting said main treating zone to said third treating zone, said second chamber being adapted to receive at least one of said cylindrical supports at a time; and d. means for isolating said second chamber in a gas-tight manner from either said main treating zone or said third treating zone.

8. A tunnel kiln as claimed in claim 1 and further comprising longitudinal means for spacing said cylindrical supports apart during their translational movement in said second and third treating zones.

9. A tunnel kiln as claimed in claim 8 and further comprising seal rings mounted on the internal surface of said second treating zone so as to contact the external surface of said cylindrical support, said seal rings being arranged in pairs the spacing of which is greater than the length of said longitudinal means.

10. A tunnel kiln as claimed in claim 1 wherein each of the cavities in said cylindrical supports is shaped to receive a single cylindrical product the longitudinal axis of which is parallel to the longitudinal axis of the cylindrical support in which it is received.

11. A tunnel kiln as claimed in claim 1 and further comprising means for keeping the cylindrical surfaces of adjacent cylindrical supports from coming into contact with each other during their translational movement in said main treating zone.

* * * * *